United States Patent [19]

Almér et al.

[11] Patent Number: 4,661,010

[45] Date of Patent: Apr. 28, 1987

[54] CONCRETE BLOCK

[76] Inventors: Bengt O. Almér, Saltholmsgatan 55, Västra Frölunda S-421 06, Sweden; Karl G. Gidlöf, Mühlegasse 9B, Baar CH-6340, Switzerland

[21] Appl. No.: 690,373

[22] PCT Filed: Jun. 1, 1982

[86] PCT No.: PCT/SE82/00195

§ 371 Date: Jan. 28, 1983

§ 102(e) Date: Jan. 28, 1983

[87] PCT Pub. No.: WO82/04272

PCT Pub. Date: Dec. 9, 1982

Related U.S. Application Data

[63] Continuation of Ser. No. 464,506, Jan. 28, 1983, abandoned.

[30] Foreign Application Priority Data

Jun. 1, 1981 [SE] Sweden ..... 8103419

[51] Int. Cl.[4] ..... E01F 13/00

[52] U.S. Cl. ..... 404/6; 404/9

[58] Field of Search ..... 404/6, 7, 9, 12, 13; 256/13.1; 52/281, 285

[56] References Cited

U.S. PATENT DOCUMENTS

| | | | |
|---|---|---|---|
| 1,927,189 | 9/1933 | Sory | 256/13.1 X |
| 3,330,084 | 7/1967 | Russell | 52/281 X |
| 3,432,978 | 3/1969 | Erickson | 52/281 X |
| 3,678,815 | 7/1972 | Younker | 404/6 X |
| 3,980,279 | 9/1976 | Bofinger | 52/583 X |
| 4,035,972 | 7/1977 | Timmons | 52/281 X |
| 4,059,362 | 11/1977 | Smith | 404/6 |
| 4,089,615 | 4/1978 | Almér et al. | 404/6 |
| 4,105,353 | 8/1978 | Bórk et al. | 404/6 X |
| 4,113,400 | 9/1978 | Smith | 404/6 |
| 4,186,533 | 2/1980 | Jensen | 52/285 X |
| 4,249,832 | 2/1981 | Schmanski | 404/6 |
| 4,348,133 | 9/1982 | Trent | 404/6 |
| 4,376,594 | 3/1983 | Prosenz | 404/6 |
| 4,406,563 | 9/1983 | Urlberger | 404/6 |
| 4,435,106 | 3/1984 | Förster et al. | 404/6 |
| 4,498,803 | 2/1985 | Quittner | 404/13 X |

FOREIGN PATENT DOCUMENTS 399084 1/1978 Sweden .

OTHER PUBLICATIONS

American Association of State Highway and Transportation Officials, "Guide for Selecting, Locating, and Designing Traffic Barriers, 1977, pp. 82, 86, 88, 89, 202.

*Primary Examiner*—James A. Leppink
*Assistant Examiner*—Matthew Smith
*Attorney, Agent, or Firm*—Newton, Hopkins & Ormsby

[57] ABSTRACT

An improved concrete block intended to serve as a roadway defining member. The block is in the shape of an elongate concrete body having an essentially triangular cross-sectional configuration with one bottom face and two preferably symmetrical side faces. Each side face is formed closest to the bottom face with a straight threshold portion sloping at a gradient of 1:5, which portion is connected to a second straight portion sloping at a gradient of 1:7 via an essentially circularly arcuate concave portion.

5 Claims, 3 Drawing Figures

CONCRETE BLOCK

This application is a continuation of application Ser. No. 464,506, filed Jan. 28, 1983, entitled: IMPROVED CONCRETE BLOCK, now abandoned.

BACKGROUND OF THE INVENTION

The subject invention concerns improvements in concrete blocks designed to serve as road barriers, and roadway or lane defining members. The blocks have an elongate concrete body with an essentially triangular cross-sectional shape including one bottom face and two preferably symmetrical side faces.

In four-lane traffic routes median barriers and roadway defining members are often used to prevent vehicles travelling in one direction from entering the lanes in which the vehicles are moving in the opposite direction. In case of accidents caused by skidding, aqua-planing, tyre punctures or careless driving such road barriers may prevent the vehicles involved in the accidents from colliding head-on with oncoming traffic.

The barriers and roadway defining means usually consist of concrete plinths to which horizontal steel beams are attached. One disadvantage with barriers and roadway defining members of this kind is that the steel material of the beams make them somewhat resilient, with the result that vehicles colliding with the barrier at an oblique angle of impact as a rule will be thrown back towards the vehicles travelling in a direction parallel with that of the colliding vehicle, or even be thrown off the road. A comparatively harmless accident therefore may have very serious consequences.

Road barriers of the kind referred to above are permanently anchored, that is, they cannot be opened up to allow the traffic to be rerouted onto adjoining traffic lanes in case one lane or roadway is blocked off. Nor is it possible to use this kind of road barriers to protect workmen engaged in temporary road work.

It is also known to use concrete blocks as median barriers to separate opposing traffic roadways. The blocks have a triangular cross-sectional shape and may be moved temporarily to divert traffic in case of accidents and may also be used as protection during road work. Cases have been reported, however, when as a result of aqua-planing or skidding, vehicles hit a row of concrete blocks at an acute angle and roll over the blocks and onto the lane of oncoming traffic, thus causing serious accidents. Also when vehicles hit the concrete blocks at low speeds the damages to the front part of the car chassis have proved to be so serious that the car has to be towed from the place of accident and be repaired at great expense.

The purpose of the road block in accordance with the subject invention is to prevent vehicles hitting the barriers from rolling over the barriers, from being thrown into the lane of parallel traffic or from being damaged to such an extent that the vehicle must be towed away. The road block is furthermore intended for use in temporary road work. It is also designed to allow individual, damaged blocks to be easily replaced, to allow water runoff, and to be rapidly and easily dismantled and removed for asphalting and other paving work or when an opening is desired through the barrier. The block in accordance with the invention furthermore serves as a blind, screening off glaring and blinding lights from oncoming traffic. In addition, it is designed to allow road signs, lights poles and noise-reducing mats to be mounted thereon.

SUMMARY OF THE INVENTION

To achieve these purposes, the block in accordance with the subject invention is characterised in that each side face of the block is formed in the area closest to the bottom face with a straight threshold portion sloping at a gradient of 1:5, said portion being interconnected to a second straight portion sloping at a gradient of 1:7 via an essentially circular arcuate concave portion.

BRIEF DESCRIPTION OF THE DRAWINGS

The invention will be described in closer deetail in the following with reference to one embodiment thereof illustrated in the accompanying drawings, wherein FIG. 1 is an end view of a concrete block in accordance with the invention.

DETAILED DESCRIPTION OF A PREFERRED EMBODIMENT

Figure 3:
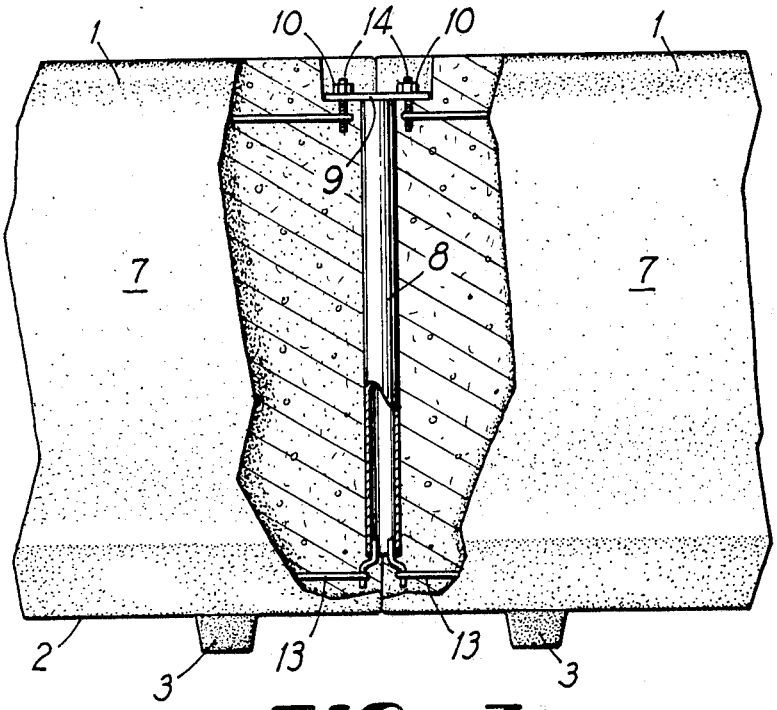
FIG. 3 shows two interlocked blocks.
Figure 4:
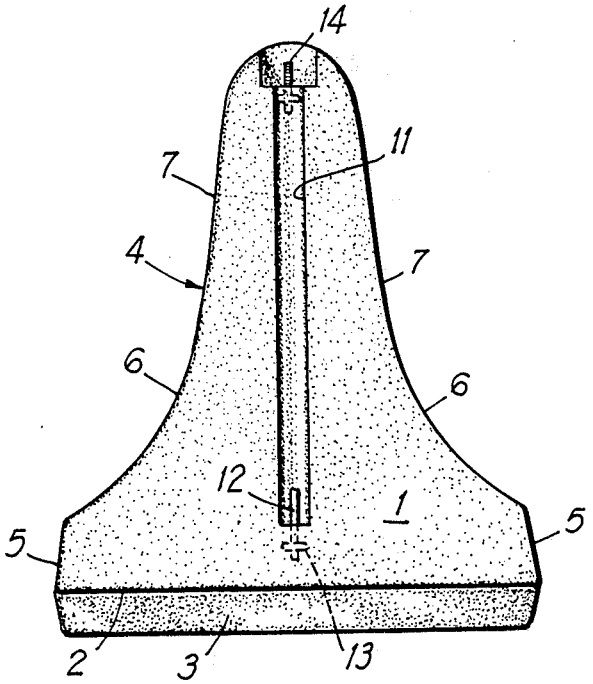

The concrete block 1 is supported on feet 3 formed on a bottom face 2, said feet being provided to allow water to flow freely underneath the block. The side faces 4 have a profiled shape incorporating a lower straight threshold portion 5, a concave arcuate portion 6 and an upper sloping portion 7 on either side of the block.

The gradient of the slope of the threshold portion 5 is 1:5. It is designed to turn the front wheel of a vehicle hitting the block at a small angle of impact in a direction in parallel with the lengthwise extension of the barrier. As a result, the vehicle will continue its travel alongside the barrier of concrete blocks without being damaged or causing serious accidents.

When the angle of impact of the vehicle is larger and the speed higher the vehicle will "climb" over the threshold portion 5 up onto the concave arcuate portion 6. This will consume some of the kinetic energy of the vehicle. When the angle of impact is large the vehicle will "climb" high up onto the sloping portion 7 the gradient of which is 1:7, and the majority of the kinetic energy of the vehicle will then be consumed. However, the deceleration is not so abrupt that vehicles behind run the risk of driving into the vehicle colliding with the barrier, which might otherwise have resulted in a chain of collisions.

When it is "climbing" up the barrier the vehicle will automatically be guided in a direction in parallel with the barrier and the rear wheel of the vehicle will follow the front wheel up onto the barrier. In the initial phase a considerable amount of the kinetic energy will be absorbed by the tyres and the suspension of the vehicle. A further amount of the energy may be absorbed through the concrete blocks because the latter, being interlocked into a long chain forming the barrier, may be displaced somewhat laterally on the feet 3.

Figure 2:
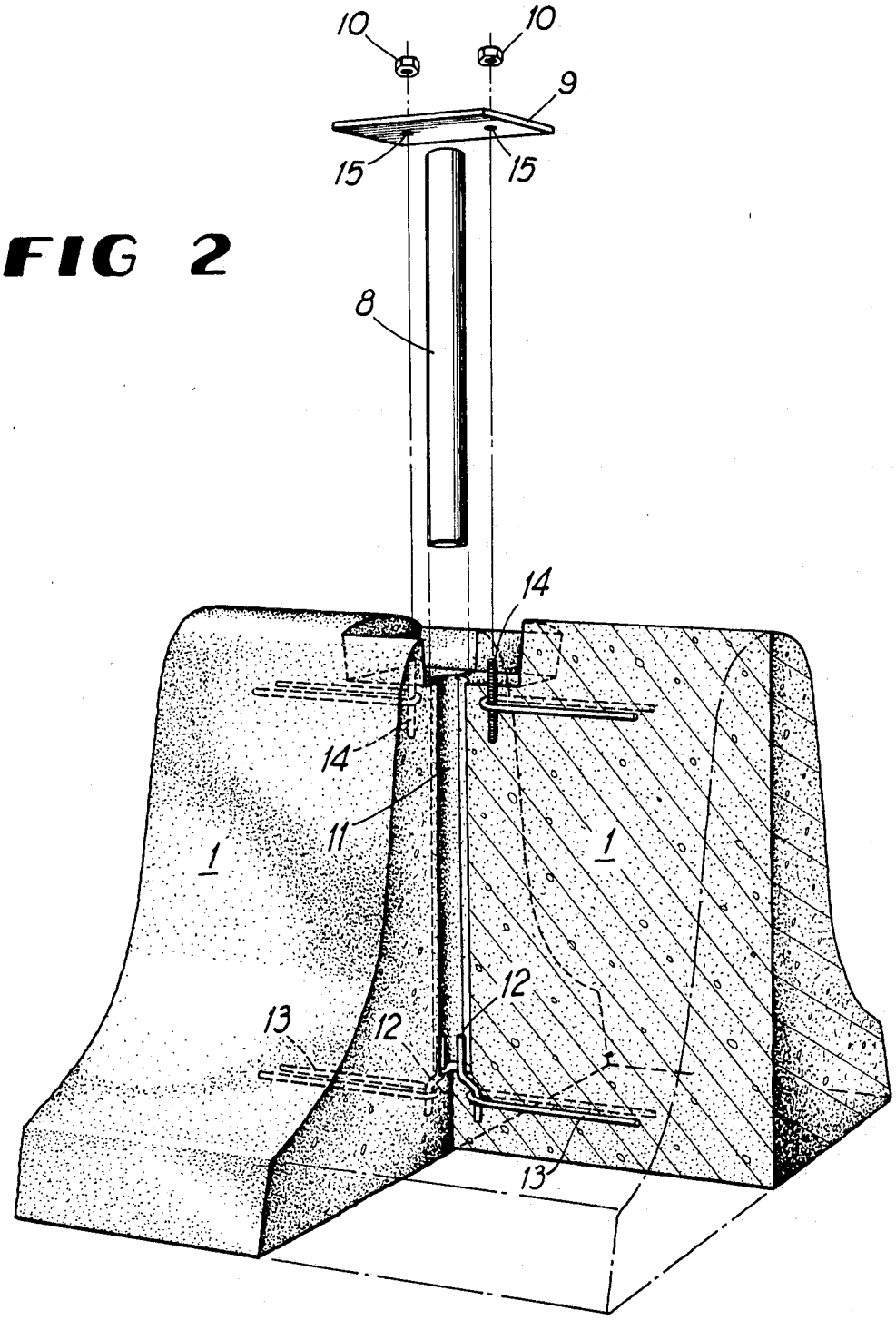
FIG. 2 is a broken view of two blocks in accordance with the invention with means for interlocking these two blocks together.

The means for interlocking the blocks 1 to one another are shown in FIG. 2 and comprise a tube 8, a retaining plate 9 and two nuts 10. At each end the concrete blocks 1 are provided with a centrally located and vertically extending groove 11. The groove 11 terminates short off the base face 2 of the block and is provided at its lower end with a vertically extending pin 12 which is directed upwards. When two blocks 1 have been placed end-to-end the two grooves 11 of adjoining blocks together form a channel in which the tube 8 may be inserted from above. When the tube 8 is inserted fully into the channel it encloses the two pins 12 which are connected with reinforcement irons 13 cast into the block. At the upper end of the channel and spaced from the latter there is provided a threaded pin 14, one adjacent each side face of the block. The retaining plate 9 is formed with apertures 15 matching the pins 14 and the plate may be locked to the latter with the aid of the nuts 10. Each end face of the blocks is slightly bevelled, which allow the blocks, being interconnected at the centre line, to be locked together along the radius of a curve.

The interlocking means in accordance with the invention are capable of withstanding considerable stress without breaking while at the same time they allow interlocked blocks to be rapidly and easily disconnected from one another. Road signs, light poles and noise-reducing mats may be mounted at the interlocking means.

The concrete blocks in accordance with the subject invention have been tested by the Swedish National Road and Traffic Research Institute (VTI). The tests show that vehicles colliding with a barrier formed by blocks in accordance with the subject invention as a rule may be driven away from the place of the accident without further. Only in cases of extremely heavy collisions is it necessary to tow the vehicle away. However, not even when the impact from the vehicle colliding with the barrier is extremely strong has one been able to detect any tendencies in the colliding vehicle to bounce away from the barrier in a direction towards the cars travelling in parallel lanes or to roll over the barrier and into the lane of the oncoming traffic.

The invention is not limited to the embodiment described in the aforegoing but various modifications are possible within the scope of the appended claims. For instance, the height and width dimensions of the concrete blocks may differ, the essential feature of the invention being the provision in the block of a lower straight threshold portion sloping at a gradient of 1:5, a concavely arcuate portion 6 and an upper sloping portion 7 the gradient of which is 1:7. Other interlocking means than those shown to link the blocks to one another are possible.

What we claim is:

1. In a non-anchored barrier to be used on the ground surface along a roadway adjacent a lane thereof for partially consuming momentum of a vehicle driven against it while deflecting the vehicle back into the lane and causing it thereafter to be confined within a path generally parallel to the barrier and generally within the lane, the combination of:

a plurality of elongate concrete blocks arranged along a path defining the barrier, each block being of generally triangular configuration in cross-section to define, on at least that side thereof exposed to traffic and in the lowermost region of that side, a substantially flat, inwardly inclined threshold surface means having a height extending above the ground surface and an inclination sufficient for resisting climbing of a vehicle front wheel over said threshold surface means while turning the front wheels of a vehicle in a direction parallel with the barrier when a vehicle front wheel strikes the block at a small angle or low speed, upper surface means including a concave arcuate surface smoothly joining said inwardly inclined threshold surface means for further consuming momentum of the vehicle and allowing a rear wheel to follow the striking front wheel onto said upper surface means when a vehicle front wheel strikes the block in a fashion sufficient to climb over said inwardly inclined threshold surface means; and means for coupling the blocks into a chain capable of flexure to consume a still further amount of momentum of the vehicle through lateral weight displacement of adjacent blocks along the chain particularly when the vehicle climbs said inwardly inclined threshold surface means;

said blocks being disposed in end-to-end relation with adjacent blocks having substantially contiguous end surfaces, said end surfaces being vertically grooved from adjacent a bottom portion of an associated block to adjacent a top portion of an associated block so that said end surfaces define a cylindrical channel of substantially circular cross-section, said means for coupling comprising tube means received in said channels for preventing relative movement between blocks while effecting transmission of lateral and rotational forces from one block to the next, pin means received in a bottom end of each of said tube means for resisting longitudinal separation between said bottom portions of the blocks, and means joining adjacent blocks at the top portions thereof for resisting longitudinal separation between said top portions of the blocks and for blocking an upper end of each channel to retain said tube means longitudinally within its associated channel.

2. In a non-anchored barrier to be used on the ground surface along a roadway adjacent a lane thereof for partially consuming momentum of a vehicle driven against it while deflecting the vehicle back into the lane and causing it thereafter to be confined within a path generally parallel to the barrier and generally within the lane, the combination of:

a pair of concrete blocks disposed in end-to-end relation and having substantially contiguous end surfaces, said end surfaces being vertically grooved from adjacent a bottom portion of an associated block to adjacent a top portion of an associated block so that said end surfaces define a cylindrical channel of substantially circular cross-section, each block being of generally triangular configuration in cross-section so as to form a portion of said barrier;

tube means received in said channel for preventing lateral and rotational relative movement between said blocks while effecting transmission of lateral and rotational forces from one block to the other;

pin means received in a bottom end of said tube means for resisting longitudinal separation between said bottom portions of the blocks, and means joining said blocks at the top portions thereof for resisting longitudinal separation between said top portions of the blocks and for blocking an upper end of said channel to retain said tube means longitudinally within said channel.

3. In a non-anchored barrier as defined in claim 2 wherein said pin means is in the form of a member having a generally horizontal portion embedded in the concrete of its associated block and an upstanding portion received in the tube means.

4. In a non-anchored barrier as defined in claim 3 wherein the means last mentioned comprises an anchor member embedded in and upstanding from each block and a plate connecting said anchor members.

5. In a non-anchored barrier as defined in claim 2 wherein each block defines, in the lowermost region thereof, a substantially flat, inwardly inclined threshold surface means having a height extending above the ground surface and an inclination sufficient for resisting climbing of a vehicle front wheel over said threshold surface means while turning the front wheels of a vehicle in a direction parallel with the barrier when a vehicle front wheel strikes the block at a small angle or low speed, upper surface means including a concave arcuate surface smoothly joining said inwardly inclined threshold surface means for further consuming momentum of the vehicle and allowing a rear wheel to follow the striking front wheel onto said upper surface means when a vehicle front wheel strikes the block in a fashion sufficient to climb over said inwardly inclined threshold surface means.

* * * * *